United States Patent [19]

Tates

[11] 4,204,727

[45] May 27, 1980

[54] MULTIMODE REPRODUCING APPARATUS

[75] Inventor: Donald W. Tates, Fairport, N.Y.

[73] Assignee: Xerox Corporation, Stamford, Conn.

[21] Appl. No.: 35,372

[22] Filed: May 3, 1979

[51] Int. Cl.[2] ..... B65H 39/10; G03G 15/00

[52] U.S. Cl. ..... 355/3 R; 271/289

[58] Field of Search ..... 271/172, 173, 64; 355/3 SH, 14, 72, 8

[56] References Cited

U.S. PATENT DOCUMENTS

| | | | |
|---|---|---|---|
| 3,744,790 | 7/1973 | Hoffman | 271/64 |
| 3,877,804 | 4/1975 | Hoppner | 355/3 R X |
| 3,948,505 | 4/1976 | Miller et al. | 271/64 |
| 3,973,769 | 8/1976 | Cross et al. | 271/173 |
| 4,053,221 | 10/1977 | Lynch | 355/8 |
| 4,111,410 | 9/1978 | Tates et al. | 271/173 |
| 4,114,871 | 9/1978 | Botte | 271/173 |
| 4,116,429 | 9/1978 | Van Buskirk et al. | 271/173 |
| 4,124,204 | 11/1978 | Van Buskirk | 271/173 |
| 4,135,805 | 1/1979 | Taylor et al. | 355/3 R |

FOREIGN PATENT DOCUMENTS

| | | | |
|---|---|---|---|
| 1401465 | 7/1975 | United Kingdom | 271/64 |
| 1440557 | 6/1976 | United Kingdom | 271/173 |

*Primary Examiner*—Donald A. Griffin

[57] ABSTRACT

Multimode reproducing apparatus with a first copy catch tray and a bin sorter for collecting and sorting letter and legal size copies and also a generally vertically inclined external copy catch tray adjacent the sorter for collecting oversize copies of oversize originals. The external copy catch tray may also be used to collect any other special copy produced such as copies of magnification reduced from the original.

15 Claims, 5 Drawing Figures

MULTIMODE REPRODUCING APPARATUS

CROSS REFERENCE TO RELATED APPLICATION

Reference is made to copending application of V. Kamath, C. Vorndran U.S. Ser. No. 035,888 filed concurrently herewith entitled Copy Stacking Tray and to copending application of V. Kamath, C. Vorndran, J. Malachowski U.S. Ser. No. 035,879 filed concurrently herewith entitled Copy Stacking Tray with Restraining Fingers.

BACKGROUND OF THE INVENTION

This invention relates to an output station for a reproducing apparatus and in particular to the output station of a multimode reproducing apparatus.

In the reproduction art it has frequently been found advantageous to be able to produce copies of original documents of varying size. For example, in addition to reproducing letter size 8½×11 inch originals and legal size 8½×14 inch originals it frequently is desirable to reproduce oversize original documents and particularly documents up to a size of 14×18 inches. While it has been desired to faithfully reproduce oversized original documents, it has also frequently been desired to be able to reduce in magnification an oversized original to a letter size copy.

While the desires of reproducing original documents have been many, so have the output capabilities also been many. It has of course been traditional to collect in an output tray multiple copies of regular or legal size documents. It has also been desired to be able to collect multiple pages of a multiple page document so that collated sets of the copied original documents are obtained.

PRIOR ART STATEMENT

Whether preparing faithful reproductions of normal or oversized originals or preparing reduced magnification copies of normal or oversize originals the copies so produced have been collected in output trays. Sorters to collate multiple copies of multiple page documents have also been employed. In U.S. Pat. No. 3,744,790 to Hoffman a multimode copier is described which has a collecting tray for collecting single copies together with a sorter for use when the copier is used in a sorting mode to make multiple copies of multiple page originals. In addition, coupled within the sorter is a collecting tray to collect copies in surplus of the number of collecting trays in the sorter when used in the sorting mode of operation. Thus if there are fifteen horizontally arrayed vertical bins in the sorter and twenty copies are made, the first fifteen will fall into the individual bins and the last five will be collected in the surplus or overflow tray.

Various reproducing apparatus are available on the market which are capable of collecting and sorting copies of reproduced originals. For example, the Xerox 3400 copier has the capability of reproducing single copies of an original document and collecting them in a single catch tray. With the aid of a document handler and a copy sorter this copier is also capable of making collated sets of multiple page original documents. For example, if five copies of a five page original document are desired, each page of the five page original is fed in order to the document handler, the five copies of each page are delivered, one each to the first five bins of the sorter. This is repeated for all five pages of the original document until complete collated sets of copies are produced in the individual sorter bins. While this machine can collect a large number of copies in a single tray or it can sort copies in the sorting bins, it is not possible to reproduce oversize documents. Nor is it possible to produce copies reduced in magnification from the original. For further details of this type of reproducing apparatus reference is made to U.S. Pat. Nos. 4,111,410 to Tates et al: 4,116,204 to Van Buskirk et al, 4,124,204 to Van Buskirk and to 4,135,805 to Taylor et al.

Another multimode machine commercially available is the Xerox 3100 LDC which has an optical system which enables the machine to copy from a stationary original in a first mode of operation or from a moving original in a second fixed optical mode. The later mode is particularly adapted for copying documents larger than the conventional viewing platen size as they are fed across the platen by the document handler. U.S. Pat. No. 3,877,804 to Hoppner is illustrative of a machine similar in many respects to this machine.

A further multimode reproducing machine commercially available is the Xerox 3107 which has an optical system including a second lens to enable a reduction mode of copying. In this machine, a document may be placed on the platen and a faithful reproduction made with the use of a scanning optical system in a first mode of operation. In a second mode of operation the optical assembly is locked into position at the edge of the platen and the document feeder feeds the document past the stationary optical system. In this mode an oversized document may be faithfully reproduced. In a third mode of operation a second lens is moved from a stored position to an operative position and is used to project an image of the document onto the imaging surface at a magnification different from the first magnification. U.S. Pat. No. 4,053,221 to Lynch is illustrative of a machine similar in many respects to this machine.

Both the Xerox 3100 LDC and the Xerox 3107 do not have the capability of sorting copies made or of automatically producing a number of collated sets of a multiple page original document. Instead, each copy of a multiple page original must be separately made by copying page 1, page 2 . . . etc., in sequence or by making X copies of page 1, X copies of page 2 . . . etc., and then manually collating one copy of page 1, one copy of page 2 . . . etc., to produce a collated set.

SUMMARY OF THE INVENTION

In accordance with this invention a reproducing apparatus output station is provided. This output station provides means to transport copies produced to either a single catch tray, a sorter or an external copy catch tray which is used to collect oversized copies and other special copies such as reduced magnification copies.

More particularly, the present invention is directed to a reproducing apparatus output station comprising a sorter, copy sheet transport to transport sheets to the sorter, a first sheet collecting tray, a first decision gate to selectively direct a sheet from the transport path to the first collecting tray and a second decision gate downstream of the first decision gate to selectively direct a sheet from the transport path to a second sheet collecting tray.

The present invention also produces a multimode reproducing apparatus wherein the output station interacts with the image forming apparatus to provide the capability in a single machine of producing, collecting and sorting regular size copies as well as producing and automatically collecting oversize or special copies. It also has the capability to make reproductions of originals at reduced magnifications and automatically collect these copies. In particular, in the multimode reproducing apparatus single or multiple copies of letter or legal size up to $8\frac{1}{2}\times 14$ inches originals may be made and collected in a single output tray. Alternatively collated sets of multiple page original sets of letter or legal size may be collected in the sorter. Alternatively oversize documents up to $14\times 18$ inches may be faithfully reproduced and collected in the large external output tray. In addition, copies of reduced magnification from the original may also be collected in the external output tray.

Accordingly, it is an object of the present invention to provide a novel output station for a reproducing apparatus.

It is an additional object of the invention to provide novel multimode reproducing apparatus.

It is a further object of the invention to provide in a single reproducing apparatus the capability of producing copies of letter or legal size and collect them in a single tray or sort them into collated sets as well as producing copies of oversize documents.

It is a further object of the invention to provide a compact multimode reproducing apparatus which will sort copies of letter or legal size as well as provide automatic throughput and collection of oversized copies of oversized documents.

It is a further object of the invention to provide a compact vertical stacking arrangement for over-sized copies produced from a reproducing apparatus.

It is an additional object of the invention to provide multimode reproducing apparatus which will collect or sort letter or legal size copies as well as provide automatic throughput and collection of special copy including oversized copies or copies of reduced magnification from the original.

For a better understanding of the invention as well as other objects and further features thereof reference is had to the following drawings and description.

DESCRIPTION OF PREFERRED EMBODIMENT

The invention will now be described by reference to a preferred embodiment of the reproducing apparatus output station.

Figure 1:
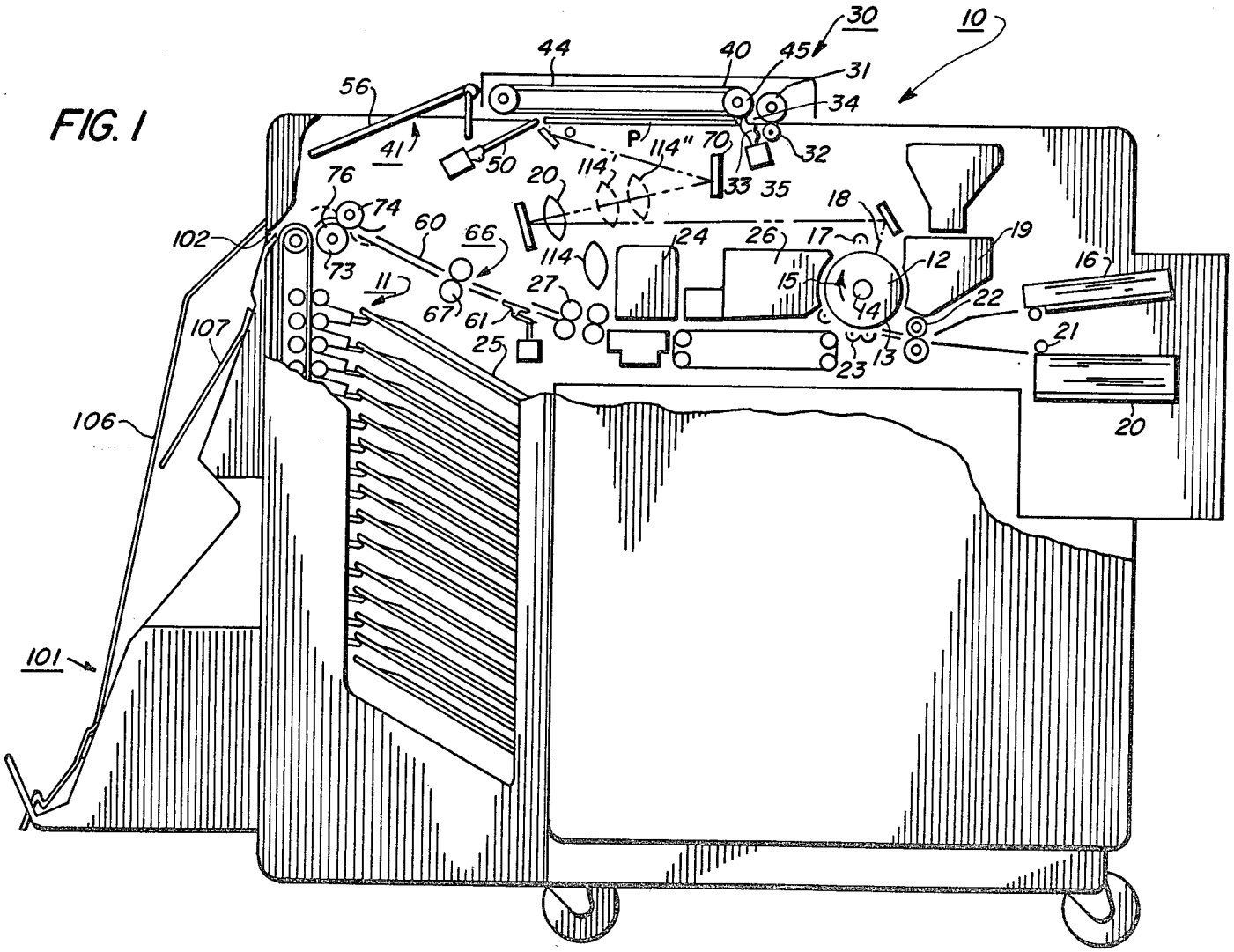
FIG. 1 is a schematic representation of an automatic xerographic reproducing apparatus employing the copy output station of the present invention.

Referring now to FIG. 1 there is shown by way of example an automatic xerographic reproducing machine 10 which includes the copy output station 11 of the present invention. The reproducing machine 10 depicted in FIG. 1 illustrates the various components utilized therein for producing copies from an original. Although the apparatuses 11 of the present invention are particularly well adapted for use in an automatic xerographic reproducing machine 10, it should become evident from the following description that they are equally well suited for use in a wide variety of processing systems including other electrostatographic systems and they are not necessarily limited in their application to the particular embodiment or embodiments shown herein.

The reproducing machine 10, illustrated in FIG. 1 employs an image recording drum-like member 12, the outer periphery of which is coated with a suitable photoconductive material 13. The drum 12 is suitably journaled for rotation within a machine frame (not shown) by means of shaft 14 and rotates in the direction indicated by arrow 15 to bring the image-bearing surface 13 thereon past a plurality of xerographic processing stations. Suitable drive means (not shown) are provided to power and coordinate the motion of the various cooperating machine components whereby a faithful reproduction of the original input scene information is recorded upon a sheet of final support material 16 such as paper or the like.

The practice of xerography is well known in the art and is the subject of numerous patents and texts including *Electrophotography* by Schaffert, and *Xerography and Related Processes* by Dessauer and Clark, both published in 1965 by the Focal Press.

Initially, the drum 12 moves the photoconductive surface 13 through a charging station 17 where an electrostatic charge is placed uniformly over the photoconductive surface 13 in known manner preparatory to imaging. Thereafter, the drum 12 is rotated to exposure station 18 wherein the charged photoconductive surface 13 is exposed to a light image of the original input scene information whereby the charge is selectively dissipated in the light exposed regions to record the original input scene in the form of an electrostatic latent image. A suitable exposure system may be of a type described in U.S. Pat. No. 3,832,057, issued to Shogren in 1974. After exposure drum 12 rotates the electrostatic latent image recorded on the photoconductive surface 13 to development station 19 wherein a conventional developer mix is applied to the photoconductive surface 13 of the drum 12 rendering the latent image visible. Typically a suitable development station could include a magnetic brush development system utilizing a magnetizable developer mix having coarse ferromagnetic carrier granules and toner colorant particles.

Sheets 16 of the final support material are supported in a stack arrangement on an elevating stack support tray 20. With the stack at its elevated position a sheet separator 21 feeds individual sheets therefrom to the registration system 22. The sheet is then forwarded to the transfer station 23 in proper registration with the image on the drum. The developed image on the photoconductive surface 13 is brought into contact with the sheet 16 of final support material within the transfer station 23 and the toner image is transferred from the photoconductive surface 13 to the contacting side of the final support sheet 16. The final support material may be paper, plastic, etc., as desired.

After the toner image has been transferred to the sheet of final support material 16 the sheet with the image thereon is advanced to a suitable fuser 24 which coalesces the transferred powder image thereto. After the fusing process the sheet 16 is advanced to a suitable output device such as tray 25.

Although a preponderance of toner powder is transferred to the final support material 16, invariably some residual toner remains on the photoconductive surface 13 after the transfer of the toner power image to the final support material. The residual toner particles remaining on the photoconductive surface 13 after the transfer operation are removed from the drum 12 as it moves through a cleaning station 26. The toner particles may be mechanically cleaned from the photoconductive surface 13 by any conventional means as, for example, by the use of a cleaning blade.

It is believed that the foregoing description is sufficient for purposes of the present application to illustrate the general operation of an automatic xerographic copier 10 which can embody the apparatus 11 in accordance with the present invention.

The document handler 30 includes an input transport comprised of input pinch rolls 31 and 32, which are selectively disengageable so that a document may be readily placed between them. The input transport 30 also includes a wait station 33 for pre-registering the document which includes a pivotally supported registration gate 34. The gate 34 and pinch rolls 31 and 32 are inter-connected so that when the gate is up in a sheet blocking position, the pinch rolls are separated. As the gate 34 drops out of sheet blocking position the pinch rolls come together to advance the document into the next station which comprises the belt-type platen transport 40.

The platen belt transport 40 is comprised of a single wide belt having one run over the platen P. This is desirable to avoid the print-out of the belt on the resulting copy sheet. The belt 40 is normally formed of a stretch-type material which is white in color so as to reduce the occurrence of a black border print-out on the copies. The belt 40 is wrapped about two pulleys 44 and 45, which are arranged so that the belt surface at the bottom of a pulley is slightly above the surface of the platen. The sag of the belt 40 is sufficient so that the belt engages the platen.

A platen registration gate 50 is provided at the far end of the platen P. The document is driven by the belt 40 against the gate 50 in order to properly position the document on the platen P for imaging. During the imaging cycle the registration gate 50 is retracted. After imaging the document is advanced off the platen P by means of the belt transport 40. The pulley 44 and belt transport 40 corrugate the document to increase its beam strength so that it will properly stack in the output tray 41 of the document handling system 30. Document decelerators 56 associated with the output tray 41 act upon the document as it enters the output tray to properly stack it therein.

The document handling system is actuated by a number of sensors. A lever actuated switch (not shown) is positioned just ahead of the nip of the input transport rolls 31 and 32 and serves to condition the machine for operation in a document handling mode. A second sensor (not shown) which preferably comprises a photocell, is arranged to sense proper corner registration of the document at the wait station 33.

In operation the document handling system 11 is activated by inserting a document into the wait station 33. This actuates the mode switch which in turn activates the input sensor and signals the logic (not shown) of the machine that a "DHS" copy is desired.

Further details of a document handler similar in many respects may be had by reference to U.S. Pat. No. 4,135,805 to Taylor et al.

Still referring to FIG. 1 the copy output station 11 is arranged adjacent the output of the xerographic processor. As a sheet 16 exits from the fuser 24, it is carried by the processor output rolls 27 along the sorter transport 60 in a general horizontal orientation. A deflection gate or pivoting chute 61 is arranged to selectively deflect the sheet 16 from the horizontal sorter transport 60 into the output tray 25 or to allow its continued advancement along the horizontal transport. When the chute 61 is in its up position as shown in solid lines in FIG. 2, the sheet 16 exits from the output rolls 27 and falls into the output tray 25 which is inclined downwardly toward the processor 10. When the chute is in its down position as shown in phantom in FIG. 2, the sheet 16 is directed forward along the horizontal sorter transport 60. The deflection chute 61 is actuated by means of a solenoid 65.

Driven pinch rollers 66 are arranged at an intermediate position along the horizontal sorter transport 60. These rollers are driven to advance the sheet at about the speed of the output rolls 27. The lower rollers 67 are pinned to driven shaft 68. The upper rollers 69 idle on shaft 71. The upper sheet guides 70 and 75 comprise wire forms which are pivotally supported in the main sorter frame.

As a sheet 16 proceeds further along the horizontal transport 60, it is fed into the nip formed by driven turn roll 73 and nip gate roll 74. With deflection gate 76 in the down position shown in solid line in FIG. 2, the sheet 16 is forced into the nip between turn roll 73 and belt drive roll 77. Upon exiting the nip the sheet 16 is guided onto the vertical transport 78 of the output station 11. The drive belts 79 are driven at high speed as compared to the horizontal transport 60 so that upon the copy sheet being gripped in the nip between the turn roll 73 and the drive belts 79, it is pulled at a high speed from the nip of the horizontal transport 60. In order to accomplish this, the driven lower rolls 67 are driven through an overrunning clutch not shown, such that the rollers can be overridden by the drive imparted to the sheet 16 by the vertical transport drive belts 79.

The vertical transport 78 is composed of a plurality of pinch roll sets 81. One set of pinch rolls may be arranged adjacent each of the bins 82 of the sorter. A plurality of spaced apart drive belts 79 are arranged across the width of the sorter from front to back. They are wrapped around belt support roll 77 and drive pulley 83 at the bottom of the vertical transport, so that this belt provides driving engagement with a sheet nipped between turn roll 73 and belt drive roll 77. The inner-run 74 of the belts 79 runs through the nips of each of the pinch roll sets 81. The pinch rolls comprising the sets 81 are arranged to idle on their respective shafts 84. A drive pulley 83 is provided at the lower end of the vertical transport 78 for providing a drive input to the belts 79. The drive belts 79 provide the driving engagement with the sheet 16 as it is carried along the vertical transport 78. The inner-inch rolls 85 are supported in the main sorter frame. The outer pinch rolls 86 are supported in a frame assembly or door 90 which is arranged to pivot away from the main sorter frame in order to allow access to the vertical transport 78 sheet path for jam clearance by the operator.

The vertical sorter bin array is composed of a plurality of sorting trays 87 arranged in a parallel fashion, one above the other, to provide a vertical row of bins 82. Each bin 82 is defined by the sheet receiving tray 87. The first bin 82A has a desired operating width for handling the desired number of copy sheets to be collected in it. The last bin 82B of the sorter 11 has a comparable width. The width of a bin 82 is defined from the sheet supporting surface of the tray 87 to the bottom surface of the next adjacent tray. The intermediate bins have a width which is less than the width of the first and last bins and thereby provide a high degree of compactness.

Associated with each of the bins 82, except the last bin 82B are a series of deflection gates 91 each supported upon a shaft 93 journaled in the sorter frame 100. A plurality of deflection fingers 92 are supported in a spaced apart relationship along each shaft 93 to define the respective gates 91. The deflection fingers 92 are arranged to project between the respective pinch rolls 81 which are also spaced apart along their respective shafts 84. A stationary deflection chute 94 is used to guide a sheet 16 into the last bin 82B.

The compact bins are articulated such that their bin entrances can be selectively widened as a sheet is fed into them. This is accomplished by providing levers 95 secured at the ends of the deflection gate shafts 93, which operate against the bottom surface of the tray 87 defining the top of the respective bin 82 with which the shaft 93 is associated. The levers 95 selectively operate upon the trays 87 outside the sheet path to cam them upwardly in order to widen the bin entrance opening as a sheet is fed into the bin.

Each of the trays 87 of the sorter 11 except for the top tray 25 which acts as the non-sorting output tray for the reproducing machine 10 and the bottom tray which rests on the sorter frame 100 are supported in a pivotal fashion within the sorter frame 100.

Figure 3:
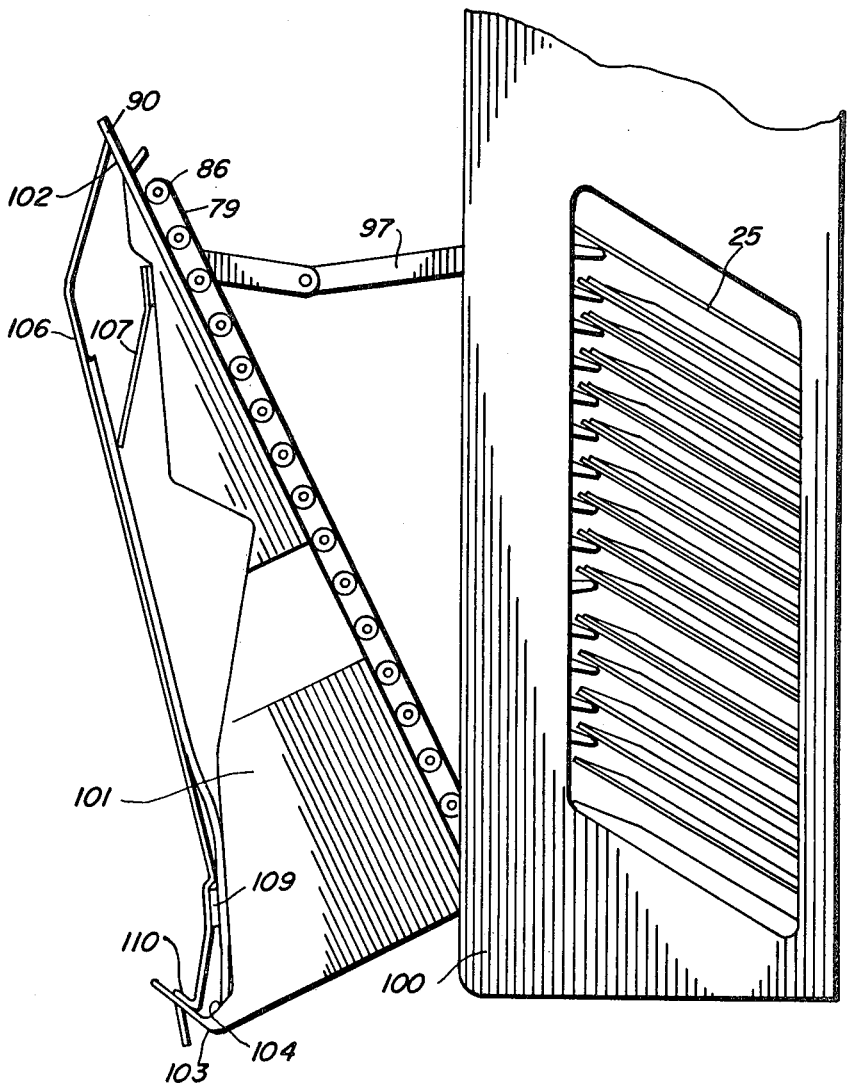
FIG. 3 is a side view of the copy output station of the present invention with the sorter door open and depicting the stacking of copies in the external output tray.

Referring to FIG. 3, it is noted that the outer bank of vertical transport pinch rollers 86 and the drive belts 79 are arranged in a door-like frame asembly 90 which can be pivoted away from the main sorter frame assembly 100 which supports the inner pinch rollers 85 and deflection gates 91. The door 90 is arranged to pivot at the bottom about the input drive shaft, not shown, which thereby makes it unnecessary to disconnect the belt drives when the door is pivoted open. Folding links 97 are pivotally supported between the door and main sorter frame in order to prevent the door from falling completely open and for limiting the degree to which the door can be opened. A latch mechanism (not shown) is provided for holding the door 90 closed during normal operation.

For further details of the sorter arrangement including the drive system and bin indexing, attention is directed to U.S. Pat. No. 4,116,429 wherein a similar apparatus is described.

The above described output station is capable of stacking multiple copies of a single document in tray 25 or with the use of the sorter of sorting multiple copies of multiple page original sets to produce collated sets. The size of the bins is such that oversized copies cannot be handled by either the output tray 25 or the sorter arrangement.

According to the present invention, a second copy collecting tray positioned external of the sorter is provided to collect special copies. Typically this is a vertical stacking tray slightly inclined to the horizontal providing a vertically downward inclined stacking direction relative to the general horizontal orientation of the sheet transport path. Copies are directed to this second copy catch tray by moving deflection gate 76 to the up position as shown in phantom in FIG. 2. The activation of deflection gate 76 between directing sheets to the vertical array of sorting bins and the external output tray may also be controlled by a solenoid in much the same manner as with deflection gate 61. This second copy collecting tray permits the reproducing apparatus to be operated in a further and different mode of operation wherein oversized documents may be faithfully reproduced and collected in the external tray 101.

With the deflection gate 76 in the up position, the copy sheets are directed to the external output tray 101 rather than into the sorter bins. Upon exit of the copy sheet through slot 102, the copy sheet is deflected down by two resilient deflection and restraining fingers 106 into the bottom 104 of the generally vertically inclined stacking tray 101. These fingers are positioned near each side of the external output tray 101. Tray 101 has a restraining lip portion 103 at the bottom to keep the individual sheets from falling out of the tray.

Figure 2:
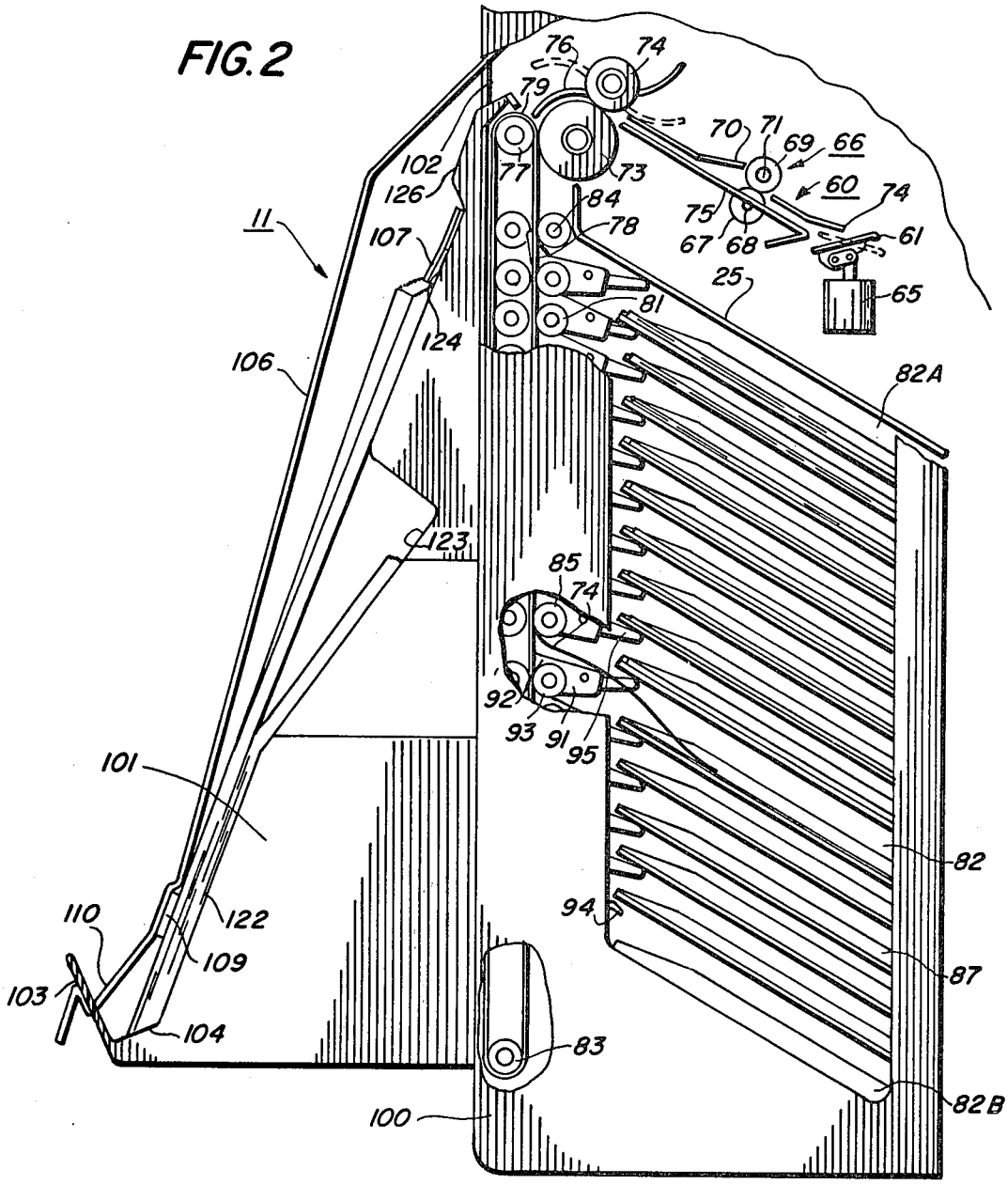
FIG. 2 is an enlarged schematic of the copy output station of the present invention depicting the stacking of copies of two sizes.

Referring to FIG. 2 tray 101 is depicted as having a first stacking portion 122 about one half the size of a copy sheet having a first size, a second stacking portion 123 also about one half the size of a copy sheet having a first size, and a third stacking portion 124 for stacking oversized copies. Briefly in operation the smaller size sheets slide down the tray with corrugating member 107 slightly bending the sheet to increase its beam strength. Upon passing the top of corrugating member 107 the sheets are stacked on portions 122 and 123 with the trailing edge out of the path of travel of the subsequently stacked sheet. When second or oversized couples are being stacked the bottom portion rests on portion 122 while the top portion rests on portion 124 out of the path of travel of subsequently stacked sheets by virtue of guide member 126.

To provide stiffness by increasing the beam strength of the individual copy sheets up to a first size such as letter or legal size a short resilient corrugating member 107 positioned under the falling copy sheets urges the sheet to bend longitudinally against the restraining action of the two deflection restraining fingers 106. This may be more completely viewed from FIGS. 4 and 5 where sheet 108 is biased in the center by corrugating member 107 between deflection and restraining fingers 106. Both the deflection and restraining fingers 106 and the corrugating member 107 are elongated resilient members as shown in FIG. 2. The corrugating member should preferably be capable of being flattened by oversize copies so that they can be neatly stacked. The deflector and restraining fingers have fiber pads at the bottom end to further act to decelerate and stack the copy sheets in the tray. These brush pads 109 include fibers that are angled with respect to the direction of movement of the copy sheets so that as the copy sheet engages the fibers it passes easily in the direction in which it is moving because of the inclination of the fibers. However, when the document reaches the end face of the tray and bounces back or attempts to reverse its direction, the frictional resistance between the fibers and the document is increased because of their inclination which causes the documents to stop and stack in a neat pile.

Figure 4:
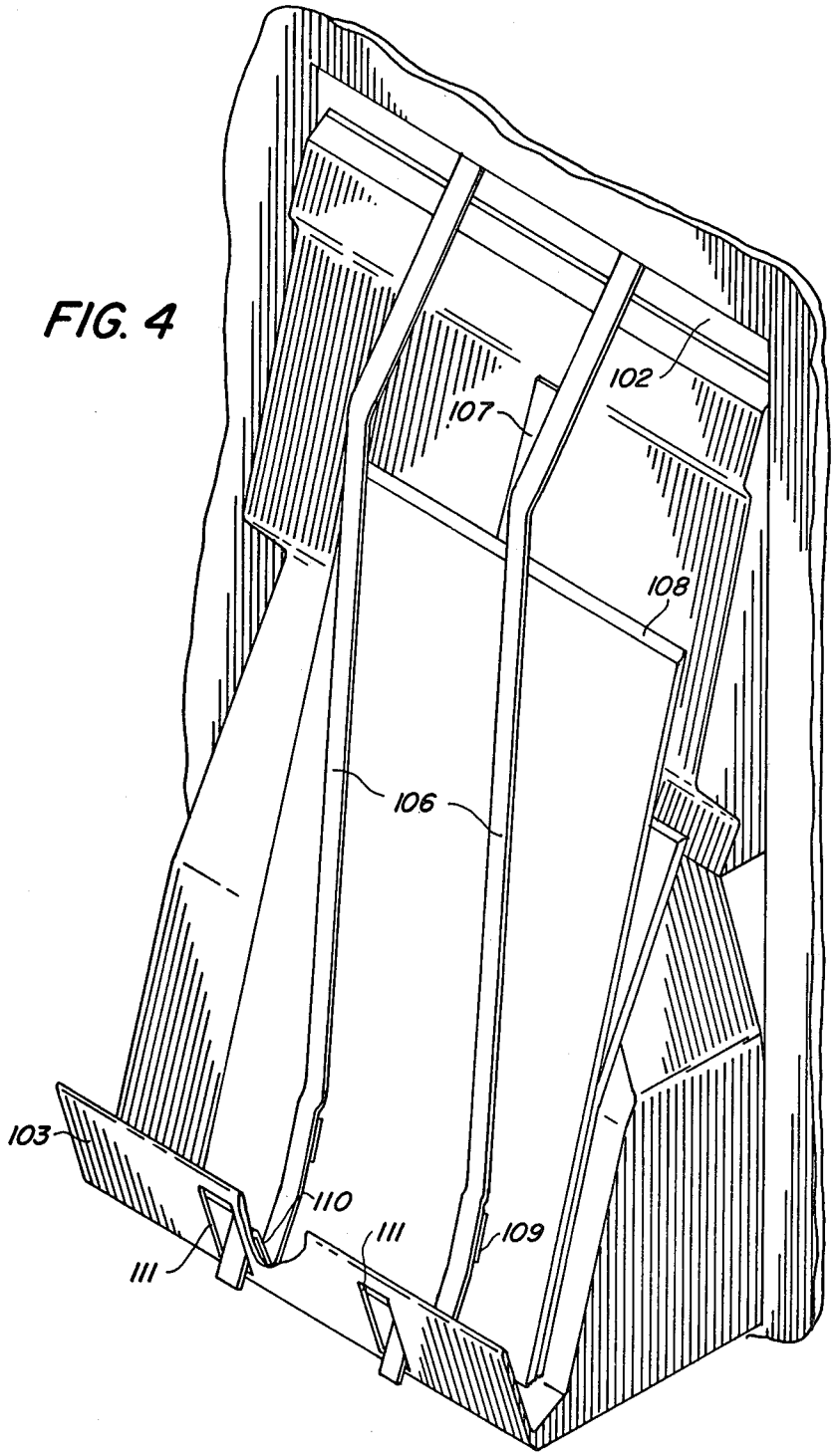
FIG. 4 is a perspective of the external output tray showing the stack retainer and corrugating member.
Figure 5:
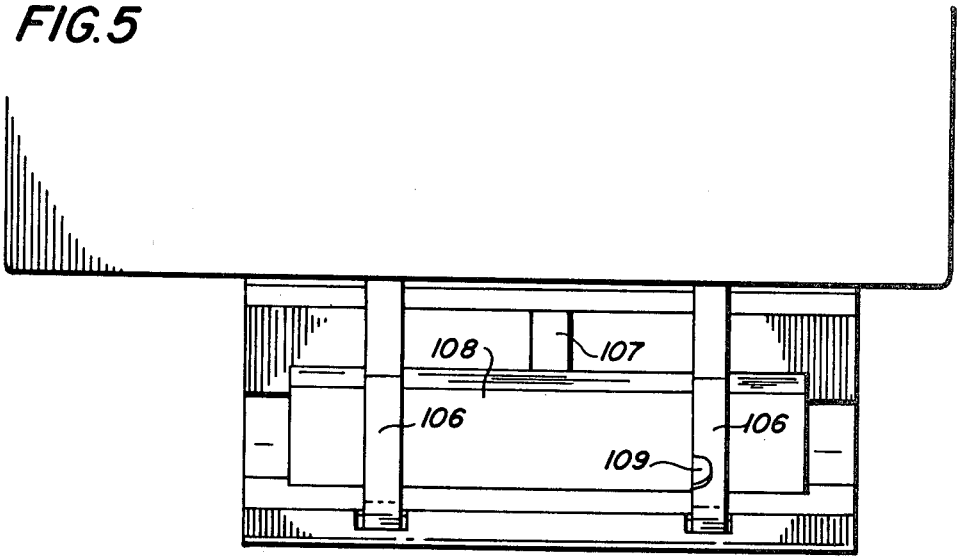
FIG. 5 is a top view of FIG. 4 showing the stack retainer and corrugating member.

As can be seen in FIGS. 3 and 4 when the sorter frame 90 is opened the deflecting and restraining fingers are maintained generally in place by the restraining hook 110 and restraining slot 111 arrangement. When the door is closed the resilient deflector and restraining finger are sufficient to deflect the sheets, slow their speed and neatly stack them in the tray. However once the door 90 is opened by pivoting counterclockwise the sheets could fall out of the tray. To prevent this each restraining finger has a restraining hook 110 at the end which when forced counterclockwise by the weight of the stack of sheets is readily inserted in restraining slot 111 in the lip portion 103 of the stacking tray. Therefore as the door 90 is opened the restraining hooks of the restraining fingers fall into the restraining slots, hook onto the back of the tray lip portion 103, and hold the copies in place in the tray.

With this additiional output capability the reproducing machine readily lends itself to operating in a number of different modes of operation. It is capable of making letter or legal size copies and collecting them in internal output tray 25 or sorting multiple copies of multiple page originals into collated sets. It is now also possible to make faithful reproductions of oversize copies and collect them in the external output tray. This may be accomplished by using the document handler and the optics in the large document mode as discussed above with reference to the Xerox 3100 LDC. Thus, in this mode of operation the optical system is fixed and locked into position near the edge of the viewing platen and the document handler feeds the oversize document across the platen P at a speed synchronized with the speed of the drum 12. Additionally, the reproducing apparatus is also capable of operating in a reduction mode whereby copies of reduced magnification from the original are produced. In this mode attention is again directed to FIG. 1 wherein a second lens 114 is depicted which may be substituted in the optical path for the main lens 20 and which may be used to produce copies of varying magnification from the original. With lens 114 in two different positions 114' and 114", copies of two different magnifications may be produced, depending on the position of lens 114 and the speed with which the document is transported across the platen. For further details of how this may be accomplished, attention is directed to U.S. Pat. No. 4,053,221 to Lynch and to U.S. Pat. No. 4,033,691 to Bierworth et al.

In these different modes of operation it is of course necessary to operate the document handler at different speeds. Thus in a base mode of operation wherein a stationary original is scanned by the optical assembly it is desirable to drive the document onto and off of the viewing platen at a speed greater than the speed of the drum 12 to thereby increase the operational copy speed of the apparatus. In the oversize document mode of operation wherein the optical assembly is fixed and the document is scanned as it moves across the viewing platen the document is transported across the platen at a speed synchronized to the speed of the drum to thereby insure a faithful reproduction. Further in any of the reduction modes the optical system is fixed in position and the speed of the document being scanned is altered depending on the reduction mgnification. Thus in this second mode of operation the document handler may be driven at different speeds to achieve the desired copy reproduction.

The control system for operating the document handler briefly described above does not form a part of the present invention and any desired system could be employed as are known in the prior art. Similarly the sorter control system does not form a part of the present invention as any desired system could be used. For example, any of the various control systems noted in the prior art referenced herein could be adapted to provide the desired control and sequencing signals.

The patents and texts referred to specifically in this application are intended to be incorporated by reference into this application.

In accordance with the invention a multimode copy output station and reproducing apparatus with such an output station have been provided. In particular an apparatus compact in size with the capability of collecting and sorting sheets up to one size as well as with the capability of producing faithful reproductions of documents of a second, larger size and with the additional capability of making other special copy such as copy of reduced magnification is provided. While this invention has been described with reference to the specific embodiments described, it will be apparent to those skilled in the art that many alternatives, modifications or variations may be made by those skilled in the art. Accordingly, it is intended to embrace all such alternatives, modifications as may fall within the spirit and scope of the appended claims.

What is claimed is:

1. A reproducing apparatus output station comprising sorter means, sheet transport means defining a sheet transport path to transport sheets from said reproducing apparatus to said sorter, a first decision gate means in the path of said sheet transport to selectively direct a sheet from the sheet transport path to a first sheet collecting tray, the improvement wherein said output station comprises a second sheet collecting tray and a second decision gate means in the path of said sheet transport to selectively direct a sheet from the path of said sheet transport to said second sheet collecting tray.

2. The apparatus of claim 1 wherein said sorter comprises a plurality of individual collecting trays stacked in a vertical array each tray having a sheet entry opening, sheet transport means to transport sheets vertically along the sheet entry opening of the vertical array of trays, and means to selectively deflect an individual sheet from the sheet transport to a selected collecting tray.

3. The apparatus of claim 1 wherein said first collecting tray is capable of collecting sheets up to a first sheet size.

4. The apparatus of claim 1 wherein said second decision gate means comprises pivotal deflection gate means.

5. The apparatus of claim 1 wherein said sheet transport path is in a general horizontal orientation from said reproducing apparatus to said second decision gate, said sorter comprises a plurality of trays in a vertical array each tray having a sheet entry opening, a second sheet transport path in a general vertical orientation past said tray sheet entry opening and wherein said second sheet collecting tray is vertically downward inclined in a stacking direction relative to the sheet transport path.

6. A multi-mode reproducing apparatus including means for exposing an imaging surface to a document to be reproduced, means to feed the document to said exposure means, means for forming an image of the document on a copy sheet, copy output transport means to transport said copy sheet to an output station, said output station comprising a sorter means, sheet transport means defining a sheet transport path to transport a sheet from said image forming means to said sorter, a first decision gate means in the path of said sheet transport to direct the sheet from the sheet transport path to a first sheet collecting tray, the improvement wherein said output station comprises a second sheet collecting tray and a second decision gate means in the path of said sheet transport to selectively direct the sheet from the path of said sheet transport to said second sheet collecting tray.

7. The apparatus of claim 6 wherein said sorter comprises a plurality of individual collecting trays stacked in a vertical array each tray having a sheet entry opening, sheet transport means to transport sheets vertically along the sheet entry opening of the vertical array of trays and, means to selectively deflect an individual sheet from the sheet transport to a selected collecting tray.

8. The apparatus of claim 7 wherein said second sheet collecting tray comprises a vertical sheet stacking tray inclined to the horizontal, said tray being adjacent the vertical array of trays in the sorter.

9. The apparatus of claim 7 wherein said sorter collecting trays are capable of collecting sheets up to a first sheet size and wherein said second collecting tray is capable of collecting sheets up to a second sheet size larger than said first sheet size.

10. The apparatus of claim 6 wherein said first collecting tray is capable of collecting sheets up to said first sheet size.

11. The apparatus of claim 6 wherein said second decision gate means comprises pivotal deflection gate means.

12. The apparatus of claim 6 wherein said sheet transport path is in a general horizontal orientation from said reproducing apparatus to said second decision gate, said sorter comprises a plurality of trays in a vertical array each tray having a sheet entry opening, a second sheet transport path in a general vertical orientation past said tray sheet entry opening and wherein said second sheet collecting tray is vertically downward inclined in a stacking direction relative to the sheet transport path.

13. A reproducing apparatus output station comprising sorter means including a plurality of collecting trays arranged in a vertical array, sheet transport means defining a sheet transport path to transport sheets from said reproducing apparatus to said sorter, a first decision gate means in the path of said sheet transport to selectively direct a sheet from the sheet transport path to a first sheet collecting tray, said output station further comprising a second sheet collecting tray and a second decision gate means in the path of said sheet transport to selectively direct a sheet from the path of said sheet transport to said second sheet collecting tray, said second sheet collecting tray comprising a vertical sheet stacking tray inclined to the horizontal, said tray being adjacent the vertical array of trays in the sorter.

14. A reproducing apparatus output station comprising sorter means including a plurality of collecting trays arranged in a vertical array, sheet transport means defining a sheet transport path to transport sheets from said reproducing apparatus to said sorter, a first decision gate means in the path of said sheet transport to selectively direct a sheet from the sheet transport path to a first sheet collecting tray, said output station further comprising a second sheet collecting tray and a second decision gate means in the path of said sheet transport to selectively direct a sheet from the path of said sheet transport to said second sheet collecting tray, said sorter collecting trays being capable of collecting sheets up to a first sheet size and said second sheet collecting tray being capable of collecting sheets up to a second sheet size larger than said first sheet size.

15. A multi-mode reproducing apparatus including means for exposing an imaging surface to a document to be reproduced, means to feed the document to said exposure means, means for forming an image of the document on a copy sheet, copy output transport means to transport said copy sheet to an output station, said output station comprising a sorter means including a plurality of collecting trays, sheet transport means defining a sheet transport path to transport a sheet from said image forming means to said sorter, a first decision gate means in the path of said sheet transport to direct the sheet from the sheet transport path to a first sheet collecting tray, said output station further comprising a second sheet collecting tray and a second decision gate means in the path of said sheet transport to selectively direct the sheet from the path of said sheet transport to said second sheet collecting tray, said second sheet collecting tray comprising a vertical sheet stacking trar inclined to the horizontal, said tray being adjacent the vertical array of trays in the sorter, said sorter collecting trays being capable of collecting sheets up to a first sheet size and said second collecting tray being capable of collecting sheets up to a second sheet size larger than said first sheet size.

* * * * *